United States Patent [19]

Wiley

[11] Patent Number: 4,904,024

[45] Date of Patent: Feb. 27, 1990

[54] ASPHALT PAVEMENT GRINDER ASSEMBLY

[76] Inventor: Patrick C. Wiley, #303, 35 - 2nd Ave. S., Williams Lake, B.C., Canada, V2G 3W3

[21] Appl. No.: 210,660

[22] Filed: Jun. 23, 1988

[51] Int. Cl.[4] ..... E02F 5/00; E01C 23/12

[52] U.S. Cl. ..... 299/39; 404/90

[58] Field of Search ..... 404/90; 299/24, 25, 299/36, 39, 40; 172/679, 680

[56] References Cited

U.S. PATENT DOCUMENTS

| | | | |
|---|---|---|---|
| 705,889 | 7/1902 | Wrobel | 404/90 X |
| 2,134,245 | 10/1938 | Carswell | 404/90 |
| 2,787,943 | 4/1957 | Browning | 404/90 X |
| 2,878,002 | 3/1959 | Haley | 299/36 |
| 3,771,831 | 11/1973 | Hatcher et al. | 299/39 |
| 4,043,601 | 8/1977 | Schiller | 299/36 |
| 4,755,001 | 7/1988 | Gilbert | 404/90 X |

*Primary Examiner*—Jerome W. Massie, IV
*Assistant Examiner*—Matthew Smith
*Attorney, Agent, or Firm*—Seed and Berry

[57] ABSTRACT

A grinding assembly for grinding asphaltic pavement which attaches to a vehicle frame and includes a grinder and a grinder blade attached to the rear of the grinder. The lower edge of the blade extends down to a bottom of the grinder so as to contact unground pavement during operation. A brace assembly is affixed to the grinder and an adjustment brace coupling is affixed to the vehicle frame and is connectable to the brace assembly. The brace coupling is adjustable to pivot the grinder to change the elevation of the grinding surface relative to the lower edge of the blade.

6 Claims, 3 Drawing Sheets

ASPHALT PAVEMENT GRINDER ASSEMBLY

BACKGROUND

The present invention relates to a grinding assembly for use in grinding old asphalt pavement prior to its removal and/or reconditioning.

Conventional asphalt grinders which include rotatable drums having protruberances or cutting edges extending from the drum surface are mounted to a fixed frame affixed to the underside of a vehicle. Ordinarily such cutters are not easily adjusted to set the depth of a cut. For example, in some vehicles it is necessary to adjust a large second frame to which the cutter is affixed with respect to a main vehicle frame in order to set the grinding depth.

During operation of apparatus which employs infra red heaters to first soften the pavement before grinding it is important to cut as deeply as possible but not so deep that the grinder must grind unsoftened asphalt. The carbide protruberances of a typical grinder last about 1 day when used on cold asphalt and about 2 weeks when used on softened asphalt. Thus, a means of carrying out a simple field adjustment of the grinder depth is desirable.

Accordingly, it is an object of the present invention to provide a grinder having an improved means of adjusting the cutting depth of the grinder.

SUMMARY OF THE INVENTION

According to the invention there is provided a grinding assembly for grinding asphalt pavement which is attachable to a vehicle frame. The grinding assembly includes a grinder and a grinder blade affixed to the rear of the grinder the grinder has a plurality of protruberances the ends of which define a cylindrical grinder surface. The blade has an edge extending to a bottom of the grinder so as to contact, when in operation, unground pavement. A brace assembly is also affixed to the grinder and an adjustable brace coupling is affixed to the frame. The adjustable brace coupling is connectable to the brace assembly and adjustable so as to pivot the grinder to change the elevation of the grinder surface relative to a bottom edge of the blade.

Preferably the brace assembly has a generally horizontally extending portion which extends transversely to an axis of the grinder. The brace coupling connects to a distal end of the extending portion.

The horizontally extending portion may extend forwardly of the grinder. The brace coupling may be a threaded screw mounted in an element affixed to the vehicle frame and rotatable, having threads registering with threads in a distal end of the portion such that, upon rotation of the screw, the distal end of the portion moves in a substantially vertical direction. A universal connection may be included in the portion such as, for example, a ball and socket connection or a link connection.

By allowing for a simple adjustment of the angle of inclination of the plane which passes through the bottom edge of the cutting blade and the outer tips of the grinder protruberances, a simple effective means of changing the grinding or cutting depth is possible.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
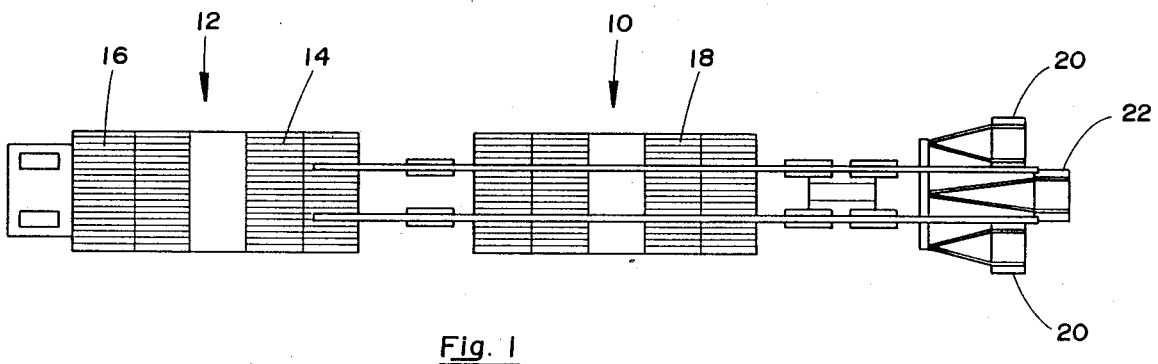
FIG. 1 is a plan view of the apparatus showing the layout of banks of infrared heating elements and the grinders located at the rear of the apparatus.
Figure 2:
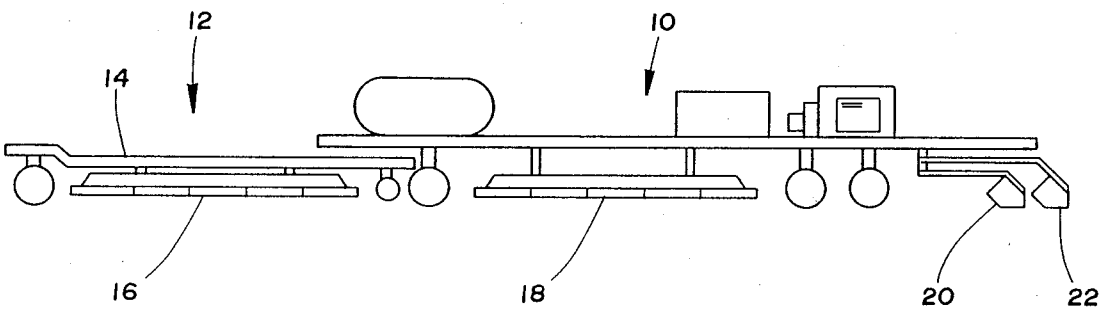
FIG. 2 is a side elevation view of the apparatus shown in FIG. 1.

Referring to FIGS. 1 and 2 there is shown a vehicle 10, self-propelled, and an attached trailer 12 coupled to the front of the vehicle 10. Trailer 12 consists of a platform 14 having front and rear wheels and a downwardly depending bank of heaters 16 fired by propane gas and generating radiant energy in the infrared region. Similarly, vehicle 10 also has two banks of heater elements 18 depending from vehicle 1. At the rear of vehicle 10 there are coupled three grinders, one central grinder 22 and two side grinders 20 located on either side of but forwardly of the central grinder 22.

Figure 3:
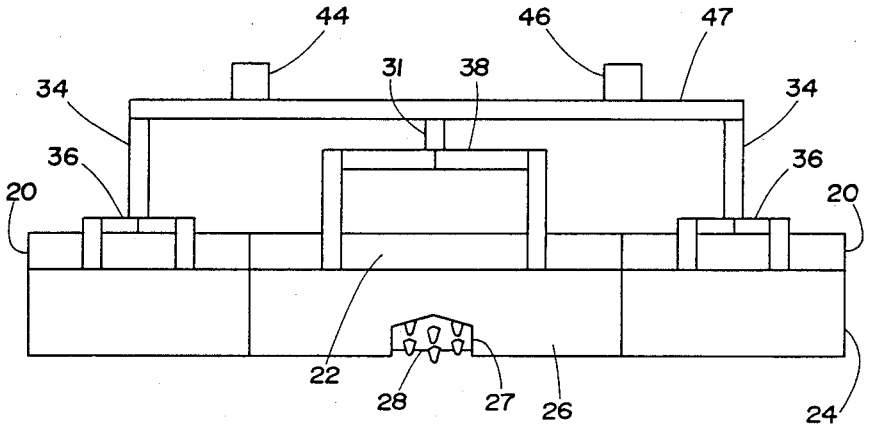
FIG. 3 is a rear elevation view of the grinder assembly.

Referring to FIG. 3 there is shown a grinder assembly consisting of a central grinder 22 and two side grinders 20 laterally disposed on either side of the central grinder 22. Rear grinder blades 24 are affixed to the rear of grinders 20 and balde 26 to the rear of grinder 22. An opening 27 centrally of the rear blade 26 permits the passage therethrough of ground asphalt material ground up by drum 28. The side grinders 20 have affixed thereto a brace assembly 36 which, in turn, is attached to a vehicle element 34 depending from a transverse beam 47 affixed to vehicle frame beams 44 and 46. Similarly, a central depending frame element 31 couples to a brace assembly 38 which, in turn, is affixed to central grinder 22. Central element 31 is rigidly affixed to beam 47.

Figure 4:
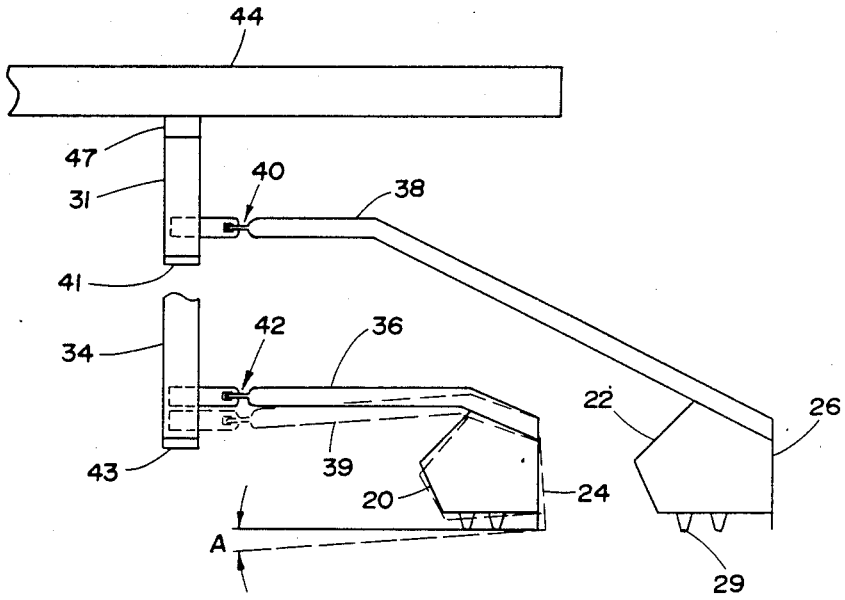
FIG. 4 is a partial side elevation view of the grinder assembly of FIG. 3.

As shown in FIG. 4 the brace assembly 38 affixed to the central grinder 22 is attached at attachment point 40 to depending central mounting post or frame element 31. Similarly, each side grinder 20 is affixed to brace assembly 36 which in turn is coupled at coupling 42 to a corresponding depending mounting post 34. The coupling 42 is identical to the coupling 40 which is shown in more detail in FIGS. 5 and 6 Lowering coupling 42 causes brace assembly 36 to rotate through an angle A to a position defined by the dashed lines 39 in FIG. 4. The latter rotation causes the end of teeth 29 of grinder 20 which defines a grinder surface to lower relative to a lower edge of blade 26.

Figure 5:
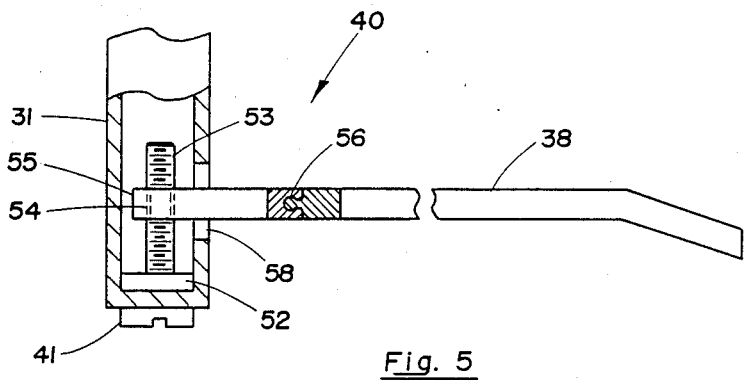
FIG. 5 is a detailed partial sectional view of the connection of the grinders to the vehicle frame assembly showing a ball and socket connection.

Referring to FIG. 5 coupling 40 consists of a screw 41 having a threaded stem 53 which registers with corresponding threads of a hole 54 through a distal end 55 of brace assembly 38. The distal end 55 fits through an aperture 58 in post 31. Affixed to the shaft 53 is a washer 52 designed to prevent movement of screw 41 in a direction along the axis of the shaft 53. Distal end 55 is coupled to the remainder of the brace assembly 38 by means of a ball and socket connection 56. The ball and socket connection 56 permits independent movement of the grinders, to a limited extend pivotally as well as rotationally about the ball of ball and socket connection 56.

Figure 6:
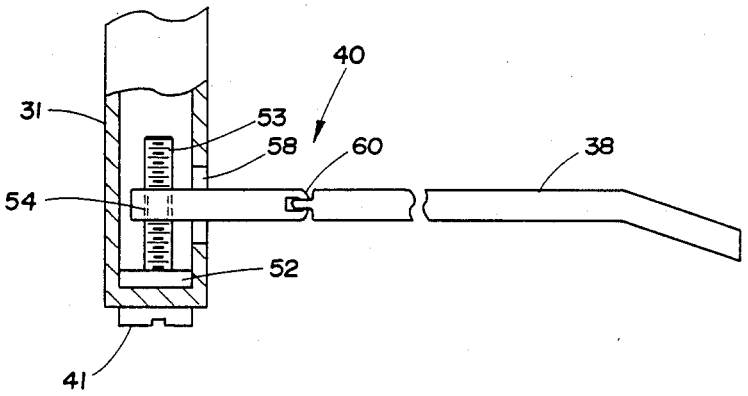
FIG. 6 is a view similar to FIG. 5 showing a link connection.

A similar connection is shown in FIG. 6 except that the ball and socket connection 56 of FIG. 5 is replaced by a link connection 60. Link connection 60 permits greater universal movement than does the ball and socket connection 56.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A grinding assembly for grinding asphaltic pavement attachable to a vehicle frame, comprising:

a grinder having a plurality of protruberances the ends of which define a cylindrical grinder surface;

a brace assembly affixed to said grinder;

an adjustable brace coupling affixed to said frame, connectable to said brace assembly and adjustable so as to pivot said grinder to change an elevation of a bottom of said grinder surface relative to a lower edge of said blade wherein the bottom of said grinder surface defines a cutting depth of said grinder.

2. An assembly according to claim 1, wherein said brace assembly has a generally horizontally extending portion extending transversely to an axis of said grinder, and said brace coupling connects to a distal end of said horizontally extending portion.

3. An assembly according to claim 2, wherein said horizontally extending portion extends forwardly of said grinder.

4. An assembly according to claim 3, wherein said brace coupling is a threaded screw mounted in an element affixed to said vehicle frame and rotatable, having threads registering with threads in a distal end of said portion such that upon rotation of said screw the distal end of said portion moves in a substantially vertical direction.

5. An assembly according to claim 4, including a ball and socket connection in said portion.

6. An assembly according to claim 4, including a link connection in said portion.

* * * * *